US009815539B1

(12) United States Patent
Provost

(10) Patent No.: US 9,815,539 B1
(45) **Date of Patent: *Nov. 14, 2017**

(54) OUTBOARD-MOTOR VIBRATION-ISOLATING COOLER METHOD

(71) Applicant: Brian Provost, Loreauville, LA (US)

(72) Inventor: Brian Provost, Loreauville, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/442,266

(22) Filed: Feb. 24, 2017

Related U.S. Application Data

(63) Continuation-in-part of application No. 15/188,204, filed on Jun. 21, 2016, now Pat. No. 9,580,159.

(51) Int. Cl.

| | |
|---|---|
| ***B63H 20/00*** | (2006.01) |
| ***B63H 20/28*** | (2006.01) |
| ***B63H 20/24*** | (2006.01) |
| ***B63H 20/32*** | (2006.01) |
| ***B63H 23/30*** | (2006.01) |

(52) U.S. Cl.
CPC ..... *B63H 20/28* (2013.01); *B63H 20/002* (2013.01); *B63H 20/245* (2013.01); *B63H 20/285* (2013.01); *B63H 20/32* (2013.01); *B63H 23/30* (2013.01)

(58) Field of Classification Search
CPC .... B63H 20/28; B63H 20/002; B63H 20/245; B63H 20/285; F01P 3/207
See application file for complete search history.

(56) References Cited

U.S. PATENT DOCUMENTS

| | | | | |
|---|---|---|---|---|
| 2,415,154 | A | 2/1947 | Water | |
| 2,466,525 | A | 4/1949 | Wilson | |
| 3,240,179 | A | 3/1966 | Van Ranst | |
| 3,310,022 | A | 3/1967 | Kollman | |
| 4,239,013 | A | 12/1980 | Haynes | |
| 4,557,319 | A | 12/1985 | Arnold | |
| 4,722,708 | A | 2/1988 | Baltz | |
| 6,149,478 | A | 11/2000 | Lehmann | |
| 7,220,154 | B2 | 5/2007 | Lawson | |
| 7,329,162 | B1 | 2/2008 | Caldwell et al. | |
| 9,580,159 | B1 * | 2/2017 | Provost | B63H 20/28 |
| 2004/0079516 | A1 | 4/2004 | Leeson et al. | |
| 2006/0040572 | A1 * | 2/2006 | Mizuguchi | F02B 61/045 440/52 |
| 2007/0107424 | A1 | 5/2007 | Wizgall et al. | |

* cited by examiner

*Primary Examiner* — Stephen P Avila
(74) *Attorney, Agent, or Firm* — Keaty Law Firm, LLC

(57) ABSTRACT

An outboard-motor vibration-isolating cooler system method providing a retrofit substitute for the midsection and the lower unit of a standard outboard motor, having a substitute closed-loop cooling system with an exterior heat exchanger, a substitute oil reservoir, a substitute exhaust system, and a substitute propulsion system with an isolating power-take-off shaft, allowing an existing standard outboard-motor powerhead to be used in conditions not conducive to standard open-loop water cooling, such as shallow-water, muddy-water, obstructed-water, seawater, or corrosive-water conditions.

20 Claims, 3 Drawing Sheets

OUTBOARD-MOTOR VIBRATION-ISOLATING COOLER METHOD

CROSS-REFERENCE TO RELATED APPLICATIONS

This application is a continuation-in-part of my co-pending application Ser. No. 15/188,204 filed on Jun. 21, 2016, the full disclosure of which is incorporated by reference herein and priority of which is hereby claimed.

BACKGROUND

This invention provides a retrofit substitute for the midsection and the lower unit of a standard outboard motor, having a substitute closed-loop cooling system with an exterior heat exchanger, a substitute oil reservoir, a substitute exhaust system, and a substitute propulsion system having an isolating power-take-off shaft, allowing an existing standard outboard-motor powerhead to be used in conditions not conducive to standard open-loop water cooling, such as shallow-water, muddy-water, obstructed-water, seawater, or corrosive-water conditions.

The reason for this invention is that boats that navigate inland waterways, coastal marshes, and swamps, encounter areas that are shallow, sometimes filled with invasive vegetation, or silted up with mud that is too soft to walk in or use any other sort of vehicle to access. Boats, particularly shallow draft, are the only vehicle practical to access these areas, but outboard motors become useless once they travel outside of channels deep enough for cooling and exhaust systems to work properly. Also the lower unit gearbox section is not designed to deflect obstructions, or was design intended for the rugged use when encountering submerged obstructions such as, mud, logs, sand, etc.

There are boat motors built for use in these areas and situations called shallow water outboards, often times referred to as mud motors. The powerheads used presently are air-cooled engines commonly used on lawn mowers and portable generators and pressure washers. A well known problem is that these engines are very limited in horse power. The highest available horsepower engine in this class is quite low, when compared to conventional outboard motors on the same size and type of boats. The demand for higher horsepower shallow water outboard motors has been present for many years with no solution.

Outboard motors have been in production and use for over 100 years and have become very popular, efficient, and reliable. They are limited though, to clean, deeper channels.

Outboard motors would be a good alternative to the limited horsepower air-engines but they were designed and are built specifically for raw water cooling outboard lower ends. The outboard engine crankshaft has no external shafting. The crankshaft does not extend out of the engine base like the presently used air-cooled engines, and only accepts the driveshaft of its intended mate, the outboard motor lower unit. It is water cooled with its water pump being built into its mate, the lower unit. The outboard-motor powerhead has no exhaust system except for its mate, the conventional lower unit and midsection. The exhaust travels through the midsection and out of the lower unit. This hot exhaust is cooled by raw cooling water after it has been supplied to the powerhead, and exiting the cooling jackets of the powerhead. So while the outboard-motor powerhead is compact, lightweight, and very reliable, it is not considered to be and option for shallow water outboard motors or any other machinery since it was designed and built with the outboard motor midsection and lower unit as a necessary part of the complete operable engine.

The combustion cycle of an engine create torque pulses that momentarily accelerate or decelerate crankshaft operation. This is caused by the firing order, the firing angle and the number of cylinders and the combustion cycle. The stop-start forces applied by torque pulses exert a twisting pressure on the drive train. These torque pulses introduce harmonic excitation forces and cause what is known as torsional vibration in a drive line, such as an outboard motor that does not have a water pump in the driven shaft. The conventional water pump creates a constant load on the outboard drive line eliminating the acceleration-deceleration effect from the engine pulses. Torque pulses ripple through the system as torsional vibrations that cannot be seen or felt like the familiar linear (up-and-down, side-to-side) type of vibration because the forces of action/reaction are distributed across different planes tangential to the drive shaft rather than confined to the same plane. Because torsional vibration is "invisible", the damage that it causes is often mistakenly attributed to some other cause such as shaft-to-shaft misalignment, improperly specified components, or faulty parts.

SUMMARY OF THE INVENTION

This invention method provides an outboard-motor vibration-isolating cooler system as a retrofit substitute for the midsection and the lower unit of an outboard motor, having a substitute closed-loop cooling system with an exterior heat exchanger, a substitute oil reservoir, a substitute exhaust system, and a substitute drive system with an isolating power-take-off shaft, allowing an existing outboard-motor powerhead to be used in conditions not conducive to standard water cooling, such as a shallow-water, muddy-water, obstructed-water, seawater, or corrosive-water conditions.

This invention provides a machined engine base and other parts that re-route conventional paths of needed lubricating oil, cooling water, and combustion exhaust gases, to areas above and outside of the midsection of the outboard motor.

This invention provides a solution for making outboard-motor powerheads usable on shallow water outboard motors. Outboard-motor powerheads are available in horsepower ranges from 2 to 250 and even larger. This invention makes all of these engines useable on shallow water outboard motors.

By keeping the coolant in a closed loop, this invention eliminates the possibility of debris such as leaves, branches, weeds and invasive vegetation from clogging the cooling system, and avoids exposure of the engine's cooling jackets to damaging salt water.

The torsional absorber coupling in the isolating power-take-off shaft solves the torsional vibration problem.

BRIEF DESCRIPTION OF DRAWINGS

Reference will now be made to the drawings, wherein like parts are designated by like numerals, and wherein.

DETAILED DESCRIPTION OF THE INVENTION

Referring to all figures generally, a preferred embodiment of the outboard-motor vibration-isolating cooler invention system apparatus 200 and method 300 are illustrated.

Figure 1:
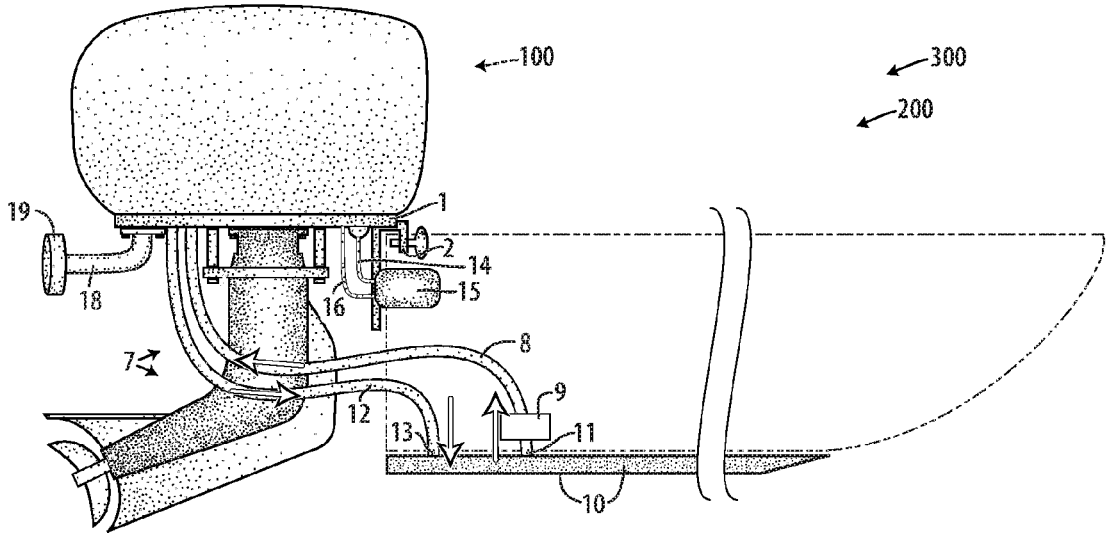
FIG. 1 is a schematic view of the outboard-motor vibration-isolating cooler system of the invention, in use.

Referring to FIG. 1, a standard outboard-motor powerhead 100 is mounted on the conversion-adapter base 1 of the outboard-motor vibration-isolating cooler. The combined unit is mounted on a boat such as the essentially flat-bottomed shallow-water boat illustrated using the provided mounting clamp 2. The surface-drive outboard-motor lower unit 7 mounted to the conversion-adapter base 1 provides propulsion in shallow, weedy, or otherwise difficult-to-navigate waters. As a substitute for coolant water normally pumped up through the standard midsection of a standard outboard motor in an open loop, with the heated water being returned and exhausted through the midsection, the outboard-motor vibration-isolating cooler provides a closed loop of water or other coolant to the standard outboard-motor powerhead 100 through a coolant-supply tube 8 driven by a coolant pump 9. Coolant heated by the standard outboard-motor powerhead is returned in a closed loop by the coolant-return tube 12. Returned heated coolant is cooled again by the heat exchanger 10. In a preferred embodiment, the heat exchanger is mounted to the boat below the waterline, such as on the keel or bottom surface of the flat-bottomed boat illustrated. The coolant in the closed loop can be pure water, or can be a mixture of water and a non-toxic antifreeze agent such as propylene glycol. In use, the coolant will be repeatedly circulated through the cooling jacket of the powerhead, so seawater or salt water or other fluids corrosive to the powerhead's engine should be avoided.

The outboard-motor vibration-isolating cooler provides an oil reservoir 15 as a substitute for the oil reservoir normally contained in the midsection of a standard outboard motor. Lubricating oil from the standard outboard-motor powerhead is routed to the oil reservoir 15 through an oil-return tube 14 and is drawn back by the powerhead's oil pump through an oil-supply tube 16. Optionally, the oil reservoir 15 can be configured to contain a volume of lubricating oil greater than the normal capacity of a standard outboard motor, in order to provide more time between circulations of any given portion of the oil. As a consequence of the external location of the oil reservoir 15, it is likely that the circulation of lubricating oil will have a cooling effect on the oil. Optionally, the oil reservoir 15 can be configured to act as a heat exchanger to further cool the oil. Also, optionally, the oil reservoir 15 can be configured to filter and clean the lubricating oil as it circulates. The optional inclusion of a viewing window or other indicator in or on the externally located oil reservoir 15 can provide an easy means of visual confirmation of the level and condition of the lubricating oil.

The standard method of porting an outboard-motor powerhead's exhaust through the standard midsection for discharge under the waterline is has some advantages in terms of muffling sound and suppressing sparks, but underwater discharge is not well-suited to operation in shallow or otherwise obstructed waters because the underwater exhaust port can become clogged or obstructed, impairing the function of the motor. The outboard-motor vibration-isolating cooler provides an exhaust pipe 18 with an exhaust muffler 19 as a substitute for the standard underwater exhaust, so that the exhaust can be discharged above the waterline with little risk of clogging or obstruction.

Figure 2:
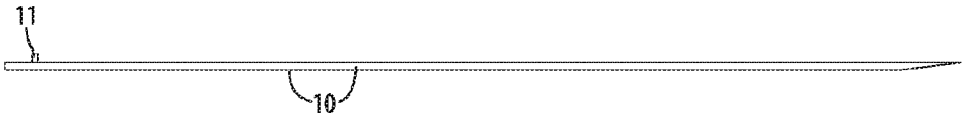
FIG. 2 is a side view of the exterior heat exchanger of a preferred embodiment of the outboard-motor vibration-isolating cooler system of the invention.
Figure 3:
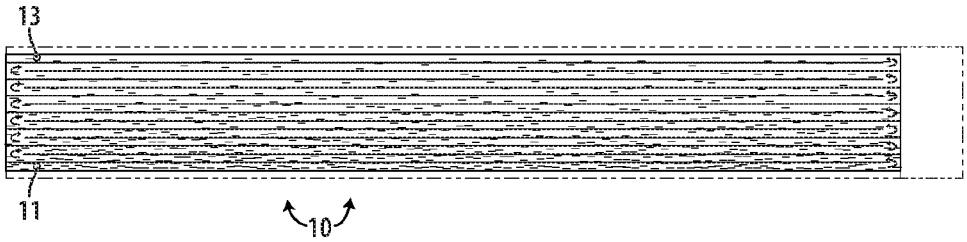
FIG. 3 is a schematic top view of the exterior heat exchanger of a preferred embodiment of the outboard-motor vibration-isolating cooler system of the invention.

Referring to FIG. 2 & FIG. 3, a preferred embodiment of the heat-exchanger 10 is adapted to be mounted to the bottom surface of the hull of a flat-bottomed boat meant to navigate in shallow or obstructed waters. Other locations are appropriate for other hull configurations. The heat-exchanger 10 should be mounted below the waterline because heat is better transferred in water than in air. For operation in extremely cold-air environments, mounting above the waterline might be preferable in order to avoid problems associated with ice below the waterline. In the preferred embodiment the heat exchanger 10 is approximately 1 inch deep and approximately 10 feet long by 16 to 24 inches wide, sized to fit a typical flat-bottomed boat, and presenting a surface area of approximately 13 to 20 square feet in heat-transferring contact with the water.

Figure 4:
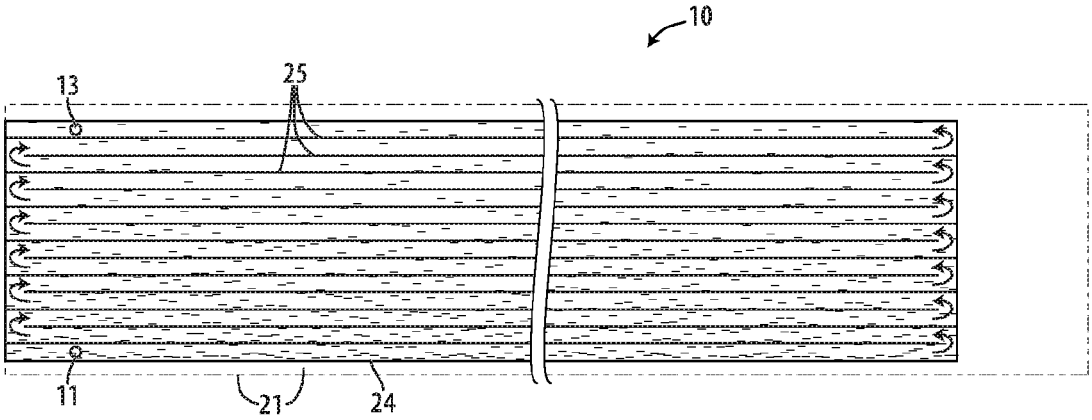
FIG. 4 is a schematic top view of the exterior heat exchanger of a preferred embodiment of the outboard-motor vibration-isolating cooler system of the invention.
Figure 5:
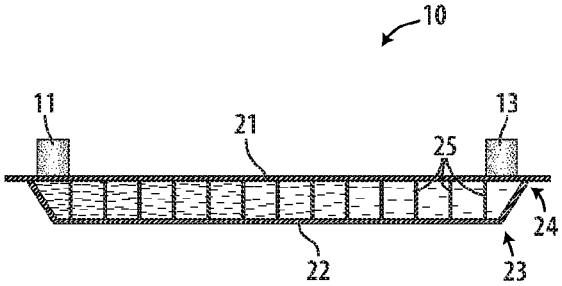
FIG. 5 is a schematic section view of the exterior heat exchanger of a preferred embodiment of the outboard-motor vibration-isolating cooler system of the invention.

Referring to FIG. 4 & FIG. 5, the heat exchanger 10 is divided into a number of separate channels communicating in a staggered pattern, forming a continuous path, in order to route any given portion of coolant through the entire heat exchanger and to segregate the coolest coolant from the influence of the hottest coolant. The separate channels are defined by heat-exchanger partitions 25. A heat-exchanger coolant-in connector 11 is located at one end of the continuous path and is meant to be connected to the coolant-return tube 12 which brings heated coolant from the standard outboard-motor powerhead 100. A heat-exchanger coolant-out connector 13 is located at the other end of the continuous path and is meant to be connected to the coolant-supply tube 8, along which is located the coolant pump 9. The coolant emerging from the heat-exchanger coolant-out connector 13 has been cooled by transfer of heat formerly contained in the coolant entering the heat-exchanger coolant-in connector 11, with such heat being transferred to the water environment in contact with and passing around the heat exchanger 10.

A preferred embodiment of the heat exchanger 10 is constructed using aluminum plate of approximately 0.25-inch thickness for the outer envelope, which comprises a heat-exchanger upper plate 21 and a heat-exchanger lower plate 22 which is bent along the lower-plate bends 23 as shown in order to form sloping sides, and is attached to the upper plate 21 along the plate-attachment points 24 as shown. The heat-exchanger partitions 25 can be constructed from aluminum plate or bar of approximately 0.1-inch thickness, in a staggered arrangement as shown in order to form one continuous path. Other materials can be used for constructing the heat exchanger 10. Such materials should allow sufficient liquid-to-liquid heat transfer and should be strong or resilient enough to withstand the intended use.

Figure 6:
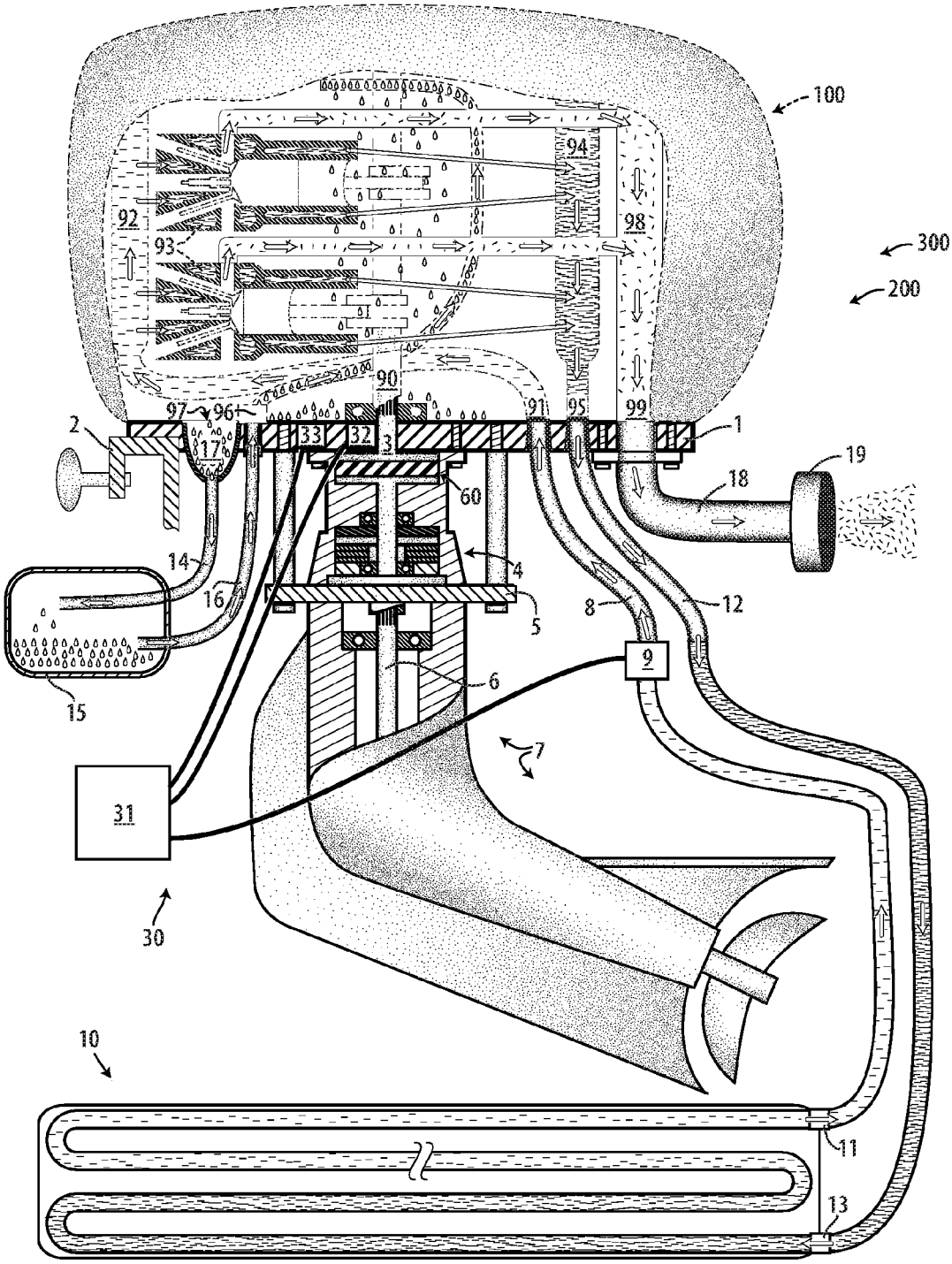
FIG. 6 is a schematic view of the outboard-motor vibration-isolating cooler system of the invention.

Referring to FIG. 6, and disclosing further details, a standard powerhead 100 of a standard outboard motor houses a cooling system having a cold-water inlet 91 leading to a cold-water manifold 92 providing cooling water to a cooling jacket 93 in the combustion cylinders, and a hot-water manifold 94 leading to a hot-water outlet 95. In a standard outboard motor, cooling water is drawn in through a channel in the standard midsection and is returned and exhausted through another channel in the standard midsection. In a standard outboard motor the lubricating oil reservoir is located in the midsection, and the powerhead 100 has an oil pump 96 to draw oil out of the midsection and an oil-return opening 97 to allow the oil to drain back into the midsection. In a standard outboard motor the engine exhaust is expelled through the midsection, and the powerhead 100 has an exhaust manifold 98 to collect exhaust gasses and an exhaust outlet 99 intended to channel exhaust through the midsection to be expelled under the waterline. The standard outboard motor has a driveshaft 90 which transfers force through the midsection and ultimately to the lower unit or gearbox and to the propeller.

The conversion-adapter base 1 when installed becomes the engine base. It is machined to fit the outboard-motor powerhead 100 and adapt the cooling system, oil system, exhaust system, and PTO drive system of more variable industry engines, particularly the shallow water outboard motor industry.

The conversion-adapter base 1 has a passage machined through it to provide an exit for the exhaust to pass through, when the midsection, often referred to as the "leg" is not present. There are threaded holes around this exhaust passage for attaching an external muffler, over the water line, eliminating the possibility of mud of other obstructions blocking the exhaust gasses from exiting the lower unit.

The bottom of the converter-adapter base 1 has a machined surface with a circular series of threaded holes for mounting the surface-drive outboard-motor lower unit 7 to the standard outboard-motor powerhead 100. The mounting is accomplished using bolts or studs passing through the lower-unit attachment surface 5 and screwed into the conversion-adapter base 1. At the end of the surface-drive outboard-motor lower unit 7 meant to be mounted to the standard outboard-motor powerhead 100 is located a bearing-and-clutch housing 4 enclosing the clutch system for controlling the transfer of rotational force from the powerhead's driveshaft 90 to the lower-unit drive shaft 6. In a preferred embodiment, the clutch system is an electric clutch which comprises an electric magnet, clutch friction drive discs, a clutch driven hub, and a flanged clutch rotor.

An isolating power-take-off shaft 3 or PTO shaft extends toward the powerhead from the bearing-and-clutch housing 4 and is adapted to be mounted to the powerhead's driveshaft 90 such that torque or rotational force can be transferred to the lower-unit drive shaft 6 and ultimately used for propulsion.

The isolating power-take-off shaft 3 prevents the transmission of torsional vibration from the powerhead to the lower-unit drive shaft 6 by providing a torsional absorber coupling 60. In a preferred embodiment, the torsional absorber coupling is a disk of an elastomeric material such as rubber or silicone which is sandwiched between two halves of the power-take-off shaft in such a way as to transmit rotational motion from the top half to the bottom half while damping the transmission of any torsional vibration that the powerhead's driveshaft 90 might be transmitting to the top half of the power-take-off shaft 3.

An oil collection cup 17 is provided in the conversion-adapter base 1 to accept lubricating oil coming from the powerhead's oil-return opening 97. From the oil collection cup 17 an oil-return tube 14 conveys the lubricating oil to the exterior oil reservoir 15. From there the oil-supply tube 16 conveys the lubricating oil back to the standard outboard-motor powerhead under negative pressure provided by the powerhead's oil pump 96.

The exhaust pipe 18 and exhaust muffler 19 are attached to the conversion-adapter base 1 such that the exhaust pipe 18 is in communication with the exhaust outlet 99 of the standard outboard-motor powerhead 100. The exhaust pipe 18 and exhaust muffler 19 provide the noise and spark suppression that are conventionally provided by the exhaust system in the standard outboard motor midsection. This exhaust pipe 18 and exhaust muffler 19 allow the engine's exhaust to exit above the waterline without excessive noise, and without being restricted by debris in the water, or mud in extremely shallow conditions.

One end of the coolant-supply tube 8 is arrayed in or on the conversion-adapter base 1 providing communication with the cold-water inlet 91 of the standard outboard-motor powerhead 100. Instead of water pumped out of the body of water through the midsection in a standard outboard motor, the coolant-supply tube 8 supplies coolant from a closed loop of coolant. The coolant pump 9 provides the force to push the coolant into the cold-water manifold 92 of the standard outboard-motor powerhead 100, and from there into and through the cooling jacket 93 surrounding the cylinders of the engine, and then into the hot-water manifold 94 and the hot-water outlet 95. One end of the coolant-return tube 12 is arrayed in communication with the hot-water outlet 95, and conveys heated coolant to the heat exchanger 10. Coolant that has been cooled in the heat exchanger 10 is returned to the cold-water inlet 91 of the standard outboard-motor powerhead 100, completing a closed loop.

The operational state and speed of the coolant pump 9 is controlled with the coolant-pump control system 30, comprising the coolant-pump controller 31 which monitors in real time the RPM sensor 32 and the temperature sensor 33 indicating the conditions within the standard outboard-motor powerhead 100. In a preferred embodiment, the coolant-pump control system 30 stops or slows the flow of coolant when the engine is colder than its optimal operating temperature, such as when first started or under extremely cold conditions. Stopping or slowing the flow of coolant under such conditions provides a benefit of allowing the engine to come up to optimal operating temperature more quickly. As the engine reaches its optimal operating temperature, the coolant-pump controller 31 motivates the coolant pump 9 to provide the proper flow rate of coolant to maintain that temperature. If the engine is becoming overheated, the coolant-pump controller 31 motivates the coolant pump 9 to provide up to the maximum flow rate in order to lower the engine's temperature.

Many other changes and modifications can be made in the system and method of the present invention without departing from the spirit thereof. I therefore pray that my rights to the present invention be limited only by the scope of the appended claims.

I claim:

1. A method for providing an outboard-motor vibration-isolating cooler system, comprising:

providing a standard outboard-motor powerhead having a driveshaft, cold-water inlet, cold-water manifold, cooling jacket, hot-water manifold, hot-water outlet, oil pump, oil-return opening, exhaust manifold, and exhaust outlet;

providing a conversion-adapter base adapted to mount to the standard outboard-motor powerhead such that the driveshaft, cold-water inlet, hot-water outlet, oil pump, oil-return opening, and exhaust outlet are mated with the proper corresponding portions of said outboard-motor vibration-isolating cooler;

providing a mounting clamp attached to said conversion-adapter base, adapted to mount upon a boat;

providing a surface-drive outboard-motor lower unit adapted to provide propulsion in conditions not conducive to water cooling, and having a lower-unit attachment surface adapted to mount said surface-drive outboard-motor lower unit to the standard outboard-motor powerhead, and having an isolating power-take-off shaft, a bearing-and-clutch housing, and a lower-unit drive shaft adapted to receive rotational force from the driveshaft of the standard outboard-motor powerhead and translate the force into propulsion;

providing a heat exchanger adapted to accept heated coolant from the standard outboard-motor powerhead from a coolant-return tube connected between the hot-water outlet of the standard outboard-motor powerhead and a heat-exchanger coolant-in connector, to cool the coolant, and to provide cooled coolant to the standard outboard-motor powerhead via a coolant-supply tube connected between the cold-water inlet of the standard outboard-motor powerhead and a coolant pump in turn connected at a heat-exchanger coolant-out connector;

providing an oil reservoir adapted to accept lubricating oil from the oil-return opening of the standard outboard-motor powerhead via an oil-collection cup connected to the oil-return opening and an oil-return tube connected between said oil-collection cup and said oil reservoir, and to supply lubricating oil to the standard outboard-motor powerhead via an oil-supply tube connected between said oil reservoir and the oil pump of the standard outboard-motor powerhead;

providing an exhaust pipe having an exhaust muffler connected to the exhaust outlet of the standard outboard-motor powerhead and adapted to expel exhaust to the environment above the waterline;

providing a coolant pump control system having a coolant pump controller in communication with an RPM sensor to ascertain the real-time rotational speed of the driveshaft of the standard outboard-motor powerhead, with a temperature sensor to ascertain the real-time temperature inside the standard outboard-motor powerhead, and in communication with and controlling the operation of said coolant pump, adapted to provide an optimum rate of flow of coolant based on the real-time temperature and rotational speed of the standard outboard-motor powerhead;

where said outboard-motor vibration-isolating cooler replaces the standard open-loop water cooling of the standard outboard-motor with a closed loop of water or other coolant, the closed loop not subject to clogging or fowling in shallow-water and other conditions not conducive to open-loop water cooling;

where said outboard-motor vibration-isolating cooler replaces the standard oil reservoir of the standard outboard-motor midsection with said oil reservoir;

where said outboard-motor vibration-isolating cooler replaces the standard underwater exhaust of the standard outboard-motor with said exhaust pipe and exhaust muffler;

where said outboard-motor vibration-isolating cooler provides an optimum flow of coolant relative to the real-time operating conditions of the standard outboard-motor powerhead;

using said outboard-motor vibration-isolating cooler system in conditions not conducive to standard open-loop water cooling.

2. The outboard-motor vibration-isolating cooler method of claim 1, said isolating power-take-off shaft further comprising two sections separated by a disk of elastomeric material such that rotational motion is transmitted from one section to the other but torsional vibration is damped.

3. The outboard-motor vibration-isolating cooler method of claim 1, where said heat exchanger is further adapted to be mounted on a below-the-waterline surface of a boat.

4. The outboard-motor vibration-isolating cooler method of claim 1, where said heat exchanger is further adapted to be mounted on the bottom surface of a flat-bottomed boat, below the waterline.

5. The outboard-motor vibration-isolating cooler method of claim 1, where said heat exchanger is further adapted to be mounted on the hull surface of a boat, below the waterline.

6. The outboard-motor vibration-isolating cooler method of claim 1, where said heat exchanger is further adapted to be mounted on the keel surface of a boat, below the waterline.

7. The outboard-motor vibration-isolating cooler method of claim 1, where the coolant is pure water.

8. The outboard-motor vibration-isolating cooler method of claim 1, where the coolant is water mixed with a non-toxic antifreeze agent such as propylene glycol.

9. The outboard-motor vibration-isolating cooler method of claim 1, where said heat exchanger further comprises a heat-exchanger upper plate, heat-exchanger lower plate, lower plate bends, plate attachment points, and heat-exchanger partitions.

10. The outboard-motor vibration-isolating cooler method of claim 1, where said oil reservoir is further adapted to cool the circulating lubricating oil.

11. The outboard-motor vibration-isolating cooler method of claim 1, where said oil reservoir is further adapted to contain a greater amount of lubricating oil than the standard outboard motor.

12. The outboard-motor vibration-isolating cooler method of claim 1, where said oil reservoir further comprises at least one cleaning or filtering element.

13. The outboard-motor vibration-isolating cooler method of claim 1, where said heat exchanger further comprises a heat-exchanger upper plate and a heat-exchanger lower plate having lower-plate bends forming sloping side walls.

14. The outboard-motor vibration-isolating cooler method of claim 1, where said heat exchanger further comprises a heat-exchanger upper plate and a heat-exchanger lower plate attached together along plate-attachment points.

15. The outboard-motor vibration-isolating cooler method of claim 1, where said heat exchanger further comprises heat-exchanger partitions.

16. The outboard-motor vibration-isolating cooler method of claim 1, where said bearing and clutch housing further comprises an electric clutch system having an electric magnet, clutch friction drive discs, a clutch driven hub, and a flanged clutch rotor.

17. The outboard-motor vibration-isolating cooler method of claim 1, where said standard outboard-motor powerhead is of 50 horsepower or greater.

18. The outboard-motor vibration-isolating cooler method of claim 1, where said standard outboard-motor powerhead is of 100 horsepower or greater.

19. The outboard-motor vibration-isolating cooler method of claim 1, where said standard outboard-motor powerhead is of 150 horsepower or greater.

20. The outboard-motor vibration-isolating cooler method of claim 1, where said standard outboard-motor powerhead is of 200 horsepower or greater.

* * * * *